US006981751B2

(12) United States Patent
Powell

(10) Patent No.: US 6,981,751 B2
(45) Date of Patent: Jan. 3, 2006

(54) WORKTABLE ENCLOSURE

(75) Inventor: Brian C. Powell, Dover, DE (US)

(73) Assignee: Metal Masters Foodservice Equipment Co., Inc., Clayton, DE (US)

( * ) Notice: Subject to any disclaimer, the term of this patent is extended or adjusted under 35 U.S.C. 154(b) by 70 days.

(21) Appl. No.: 10/643,611

(22) Filed: Aug. 18, 2003

(65) Prior Publication Data

US 2005/0040743 A1 Feb. 24, 2005

(51) Int. Cl.
*A47B 47/00* (2006.01)

(52) U.S. Cl. ..... 312/265.3; 312/257.1

(58) Field of Classification Search ..... 312/257.1, 312/263, 351, 265.1, 265.2, 265.3, 265.4, 312/324, 326, 329, 139.2, 140.3, 140.2; 108/147.12, 108/147.13, 147.15
See application file for complete search history.

(56) References Cited

U.S. PATENT DOCUMENTS 2,778,703 A * 1/1957 McBride ..... 312/265
3,856,371 A * 12/1974 Forsyth ..... 312/195
3,955,863 A * 5/1976 Yellin ..... 312/265.2
4,145,098 A * 3/1979 Alexander ..... 312/195
4,318,576 A * 3/1982 Ford ..... 312/264
4,786,122 A * 11/1988 Nichoalds ..... 312/257.1
5,002,247 A * 3/1991 Dispenza et al. ..... 248/188
5,803,561 A * 9/1998 Puehlhorn ..... 312/264
6,119,854 A * 9/2000 Prentice et al. ..... 206/209.1
6,152,553 A 11/2000 Wunderlich
6,550,880 B2 * 4/2003 Reuter ..... 312/265.3
6,764,144 B2 * 7/2004 Insalaco et al. ..... 312/108

* cited by examiner

*Primary Examiner*—Janet M. Wilkens
(74) *Attorney, Agent, or Firm*—Connolly Bove Lodge & Hutz LLP

(57) ABSTRACT

An enclosure for a worktable having a top four corner support posts with an undershelf releasably secured to the posts below the worktable top primarily comprises a pair of opposed side panels each including front and back vertical curved portions for placement around opposed pairs of front and back support posts. A horizontal lintel is releasably attached to the front underside of the worktable and the front vertical curved portions of the opposed side panels. A pair of front doors immediately below the horizontal lintel are either hingedly secured to the front vertical curved portions of the opposed side panels or slidably mounted in tracks to provide access to the space between the worktable and the undershelf.

6 Claims, 4 Drawing Sheets

WORKTABLE ENCLOSURE

BACKGROUND OF THE INVENTION

The present invention relates to an enclosure for a worktable which enables the worktable to be enclosed on three sides thereof either as a factory produced product or by way of a field retrofit assembly.

Worktables are common products used in many industries. In some instances the worktable top is supported by corner support posts, and often an undershelf spaced below the top is secured in place to the support posts.

Often it is desirable to enclose the worktable on the sides and front thereof, but the heretofore proposed arrangements for any such enclosures do not offer the flexibility with respect to production at the factory level together with the ability to utilize the enclosure on a field retrofit basis.

SUMMARY OF THE INVENTION

Accordingly, one of the objects of the present invention is an enclosure for a worktable where the enclosure has relatively few parts and is easily assembled around a worktable.

Another object of the present invention is a worktable enclosure which has the unique ability to be utilized in both factory production and by way of a field retrofit kit.

Still another object of the present invention is a worktable enclosure which is simple in construction and simple to assemble.

In accordance with the present invention an arrangement is provided for enclosing the sides and front of a worktable. The worktable may have a table top and four corner support posts with an undershelf releasably secured to the posts below the top. Preferably, the enclosure comprises a pair of opposed side panels each including front and back vertical curved portions for placement around opposed pairs of front and back support posts. A horizontal lintel is releasably attached to the front underside of the worktable top as well as to the front vertical curved portions of the opposed side panels. A pair of front doors are positioned below the lintel and the doors are either hingedably secured to the front vertical curved portions of the opposed side panels or slidably mounted in tracks. The doors provide access to the space between the worktable top and undershelf.

Additionally, the enclosure may include contoured post covers, one for each support post, positioned around the interior portions of the posts and secured to the vertical curved portions of the side panels. Moreover, each of the opposed side panels includes a lower inwardly disposed horizontal flange at a lower portion thereof secured to the upper surface of the undershelf. Similarly, each of the opposed side panels includes an upper inwardly disposed horizontal flange at an upper portion thereof abutting the underside of the worktable top.

In a preferred embodiment of the present invention, the horizontal lintel includes a recessed door stop with magnets thereon for releasably holding the metal front doors against the stop in a closed position.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 4:
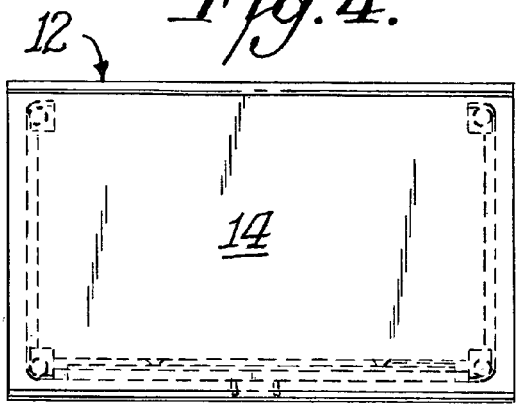
FIG. 4 is a top plan view of the enclosed worktable of FIG. 1, according to the present invention.
Figure 1:
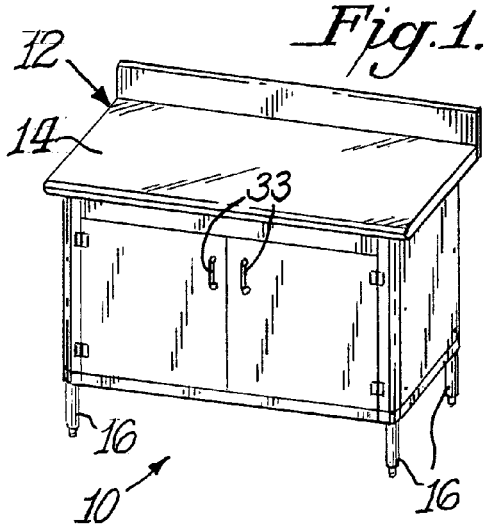
FIG. 1 is a perspective view of an enclosed worktable, according to the present invention.
Figure 2:
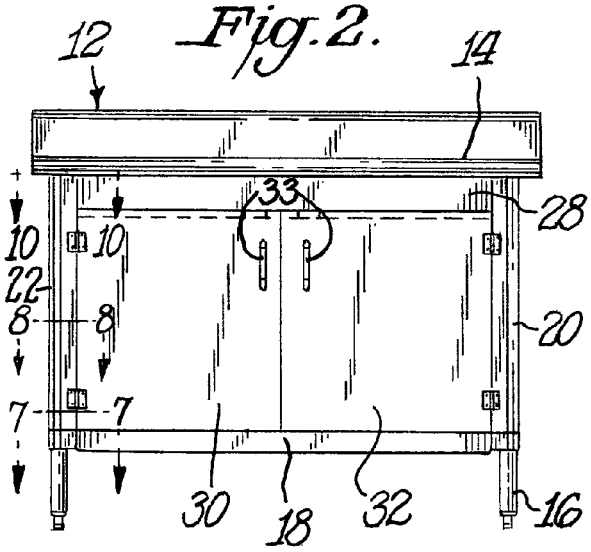
FIG. 2 is a front elevational view of the enclosed worktable of FIG. 1, according to the present invention.
Figure 3:
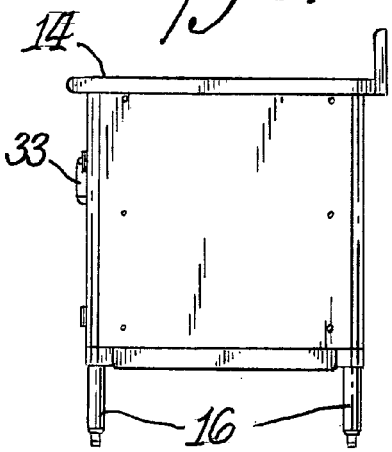
FIG. 3 is a right side elevational view of the enclosed worktable of FIG. 1, according to the present invention.

Referring in more particularity to the drawings, FIGS. 1–5 illustrate an enclosure 10 that primarily functions to enclose the opposite sides and front of a worktable 12. The worktable 12 includes a horizontal top 14 and four corner support posts 16. An undershelf 18 is releasably secured to posts 16 below the worktable top as shown best in FIG. 5.

The enclosure 10 primarily comprises a pair of opposed side panels 20, 22 each including front and back curved vertical portions 24, 26 for placement around opposed pairs of front and back support posts. A horizontal lintel 28 is releasably attached to the front underside of the worktable top as well as the front vertical curved portion 24 of each side panels 20, 22.

A pair of front doors 30, 32 are positioned below the horizontal lintel, and these doors are secured by hinges 34 to the front vertical curved portions 24 of the opposed side panels 20, 22 to provide access to the space between the worktable top 14 and the undershelf 18. Each door includes a handle 33.

As best shown in FIG. 4, the enclosure 10 further includes contoured post covers 36, one for each support post 16, positioned around interior portions of the posts and secured to the vertical curved front and back portions 24, 26 of the side panels 20, 22.

In the preferred embodiment of the present invention each of the opposed side panels 20, 22 includes a lower inwardly disposed horizontal flange 38 at the lower portion thereof secured to the undershelf 16. Similarly, each of the opposed side panels 20, 22 includes an upper inwardly disposed horizontal flange 40 at the upper portion thereof abutting the underside of the worktable top 14.

The horizontal lintel 28 may include a recessed door stop 42 with magnets 44 for releasably holding the front doors 30, 32 against the stop in a closed position.

Figure 5:
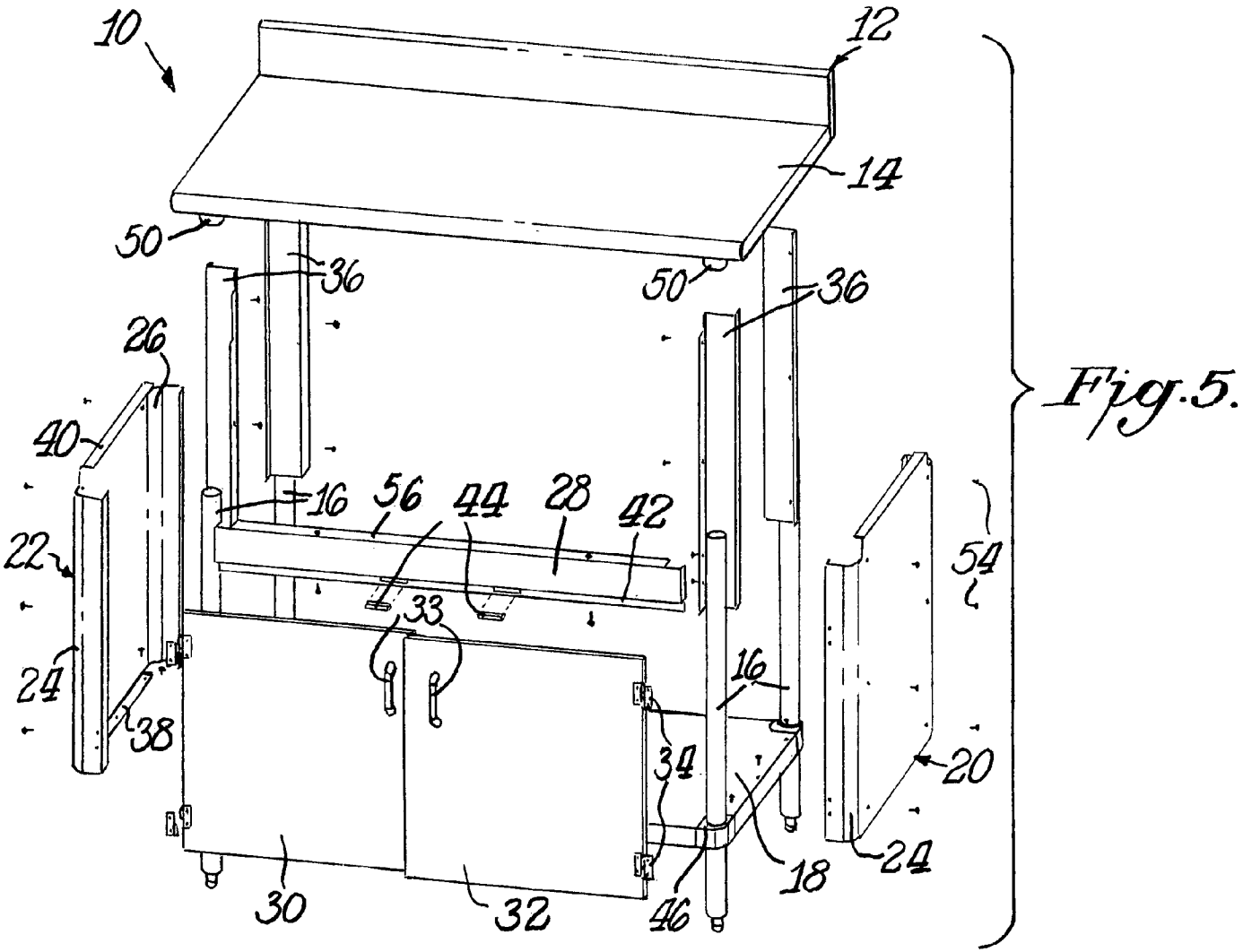
FIG. 5 is an exploded perspective view illustrating the component parts of the enclosed worktable shown in FIGS. 1–4.
Figure 7:
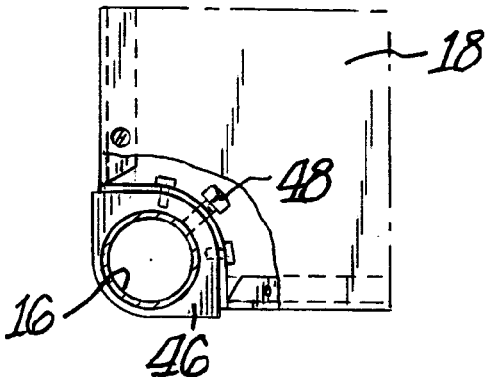
FIG. 7 is a sectional view taken along line 7—7 of FIG. 2.
Figure 10:
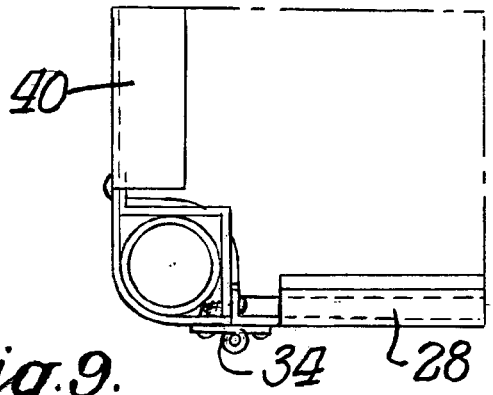
FIG. 10 is a sectional view taken along line 10—10 of FIG. 2.
Figure 6:
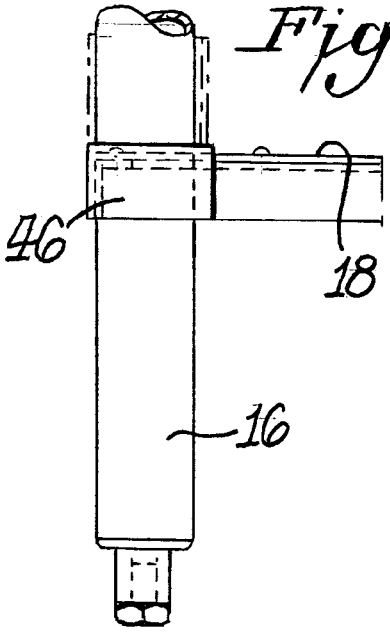
FIG. 6 is a fragmental front elevational view of the lower portion of the support posts with the undershelf secured to the posts.
Figure 9:
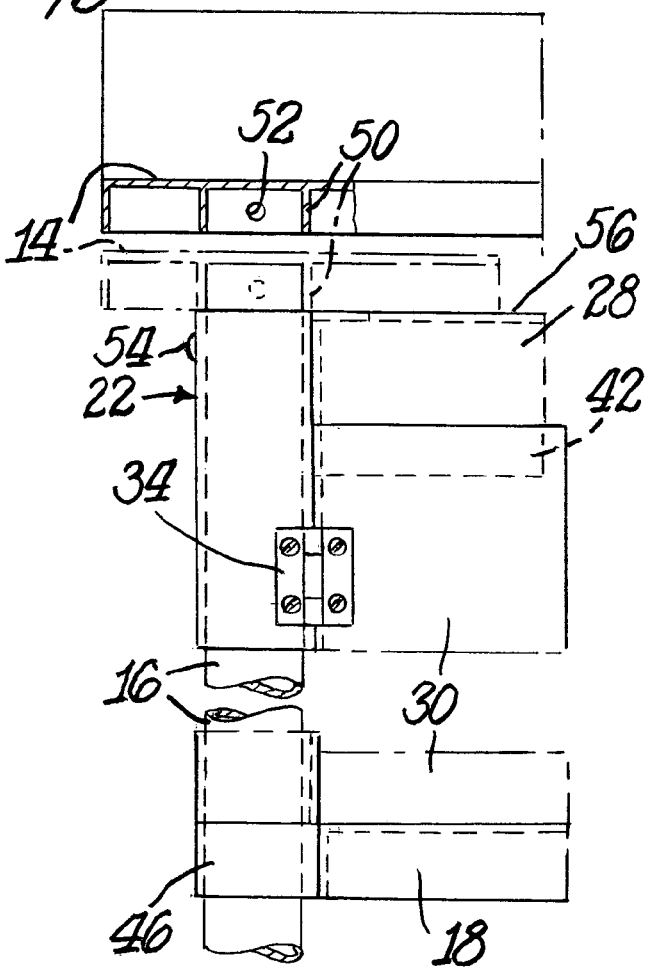
FIG. 9 is a fragmental exploded front elevational view of the assembled components of the enclosure and the worktable.
Figure 8:
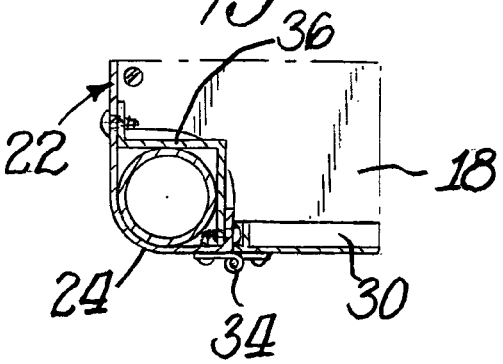
FIG. 8 is a sectional view taken along line 8—8 of FIG. 2.

As shown best in FIGS. 5 and 7 the undershelf 18 includes four corner brackets 46 each having a central opening therein for receiving the support posts 16. Once the undershelf 18 is properly positioned on the posts at a given elevation, a tightening bolt 48 on each bracket 46 is turned in a clockwise manner to anchor the brackets to the posts whereby the undershelf 18 is releasably secured to the posts.

As explained more fully below, the underside of the worktable top 14 includes four corner gussets 50 dimensioned to fit over the upper ends of the support posts 16 to thereby secure the worktable top to the support posts. A threaded opening 52 in each gusset is dimensioned to receive a tightening bolt (not shown) for securing the gussets to the tops of the support posts in a manner similar to manner in which the brackets 46 are secured with the bolts 48.

Preferably, the components of the enclosure 10 are fabricated from ferrous sheet metal, and screws 54 may be used to assemble these parts. The enclosure 10 may be assembled with the worktable 12 at the factory level and thereafter shipped as a single unit comprising both the worktable and the enclosure in assembled or partially assembled condition. Alternatively, a retrofit kit may be manufactured and sold for field use in enclosing existing worktables. Such retrofit kit includes the side panels 20, 22, the horizontal lintel 28, the doors 30, 32, and the contoured post covers 36. These components together with the required number of screw type fasteners may be sold as a unit for retrofit application.

Assembly of the enclosure 10 and the worktable 12 may be accomplished in the following manner. Initially the undershelf 18 is secured to the support posts 16 by passing the posts through the cover brackets 48 and tightening the bolts 48 to thereby position the undershelf 18 at a given height above the ground engaging end of the support posts. Next, the side panels 20, 22 are fitted over the support posts so that the curved front and back portions 24, 26 of each panel fit over the front and rear support posts. The lower flange 38 on each side panel is then attached to the undershelf 18. The horizontal lintel 28 is then attached to the curved front portions 24 of the side panels 20, 22. The magnets 44 may be then secured to the recessed door stop 42 on the horizontal lintel 28.

The table top 14 is secured to the upper ends of the support posts 16 by positioning the corner gussets 50 over the support posts. As described above, tightening bolts are then used to secure the gussets to the posts. The upper flange 40 on each of the side panels abuts the underside of the worktable top 14. Similarly, the horizontal lintel 28 may also include an upper portion 56 that engages the underside of the worktable top. The upper portion of the lintel may be secured to the underside of the worktable top by fasteners, if desired.

The contoured post covers 26 are then secured in place by fastening the covers to the side panels 20, 22. Next the hinges 34 are secured to the front curved portion 24 of the side panels 20, 22 as well as to the doors 30,32 to thereby complete the assembly.

Figure 11:
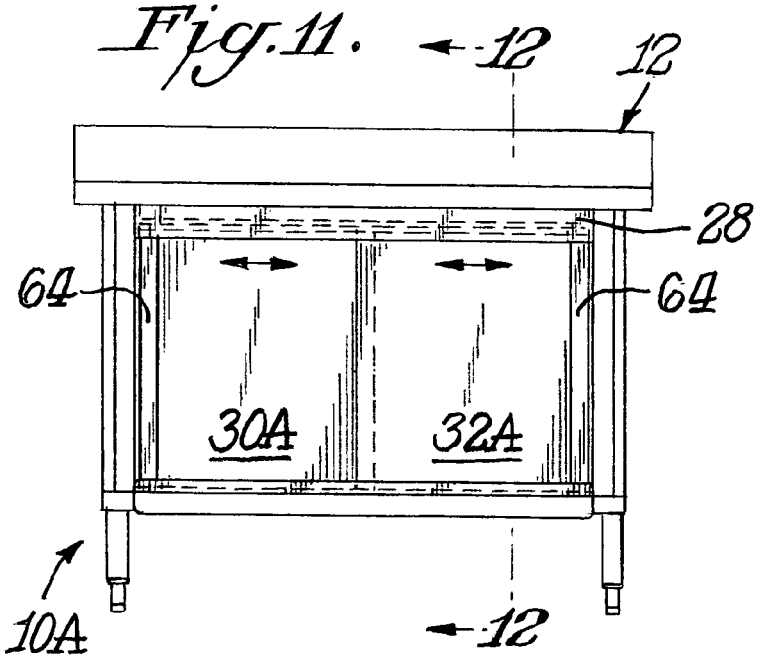
FIG. 11 is a front elevational view similar to FIG. 2, but illustrating another embodiment of the present invention with sliding front doors.
Figure 12:
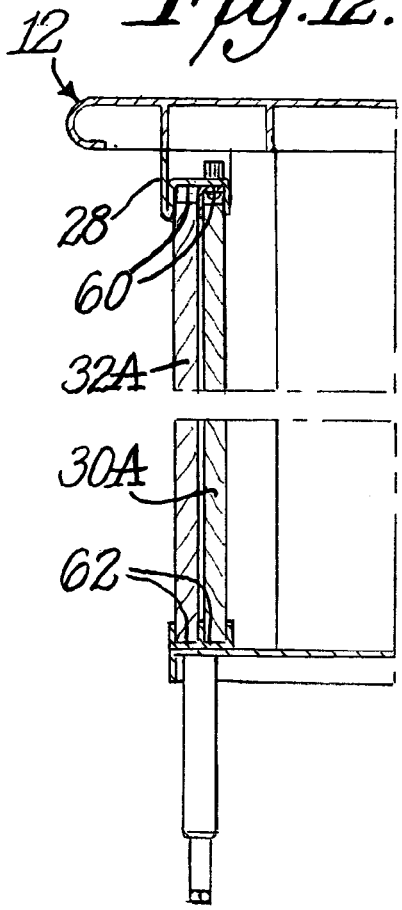
FIG. 12 is a sectional view taken along line 12—12 of FIG. 11.

FIGS. 11 and 12 illustrate another enclosure 10A of the present invention similar in many respects to enclosure 10, and similar parts are identified by similar reference characters. The major difference is that enclosure 10A includes front doors 30A, 32B slidably mounted at the front of the enclosure for side-to-side movement. Lintel 28 includes downwardly facing dual parallel tracks 60 while the undershelf 18 includes upwardly facing dual parallel tracks 62 which receive the upper and lower portions of the front door 30A, 32A. The front doors slide side-to-side in these tracks. Finger recesses 64 in the doors are used to open and close the doors.

I claim:

1. A worktable having a top and four corner support posts with an undershelf releasably secured to the posts below the worktable top, and an enclosure for the worktable, the enclosure comprising:

a pair of opposed side panels each including front and back vertical curved portions for placement around opposed pairs of front and back support posts;

a lintel releasably attached to a front underside of the worktable and the front vertical curved portions of the opposed side panels;

separate contoured post covers, one for each support post, positioned around interior portions of the posts and secured to the vertical curved portions of the side panels; and a pair of front doors secured in place below the lintel and above the undershelf constructed and arranged to provide access to a space between the worktable and undershelf.

2. A worktable and an enclosure as in claim 1 wherein each of the opposed side panels includes a lower inwardly disposed horizontal flange at a lower portion thereof secured to the undershelf.

3. A worktable and an enclosure as in claim 1 wherein each of the opposed side panels includes an upper inwardly disposed horizontal flange at an upper portion thereof abutting the worktable top.

4. A worktable and an enclosure as in claim 1 wherein the front doors are hingedly secured to the front vertical curved portion of the opposed side panels.

5. A worktable and an enclosure as in claim 4 wherein the lintel includes a recessed door stop portion with magnets for releasably holding the front doors against the recessed stop portion in a closed position.

6. A worktable and an enclosure as in claim 1 wherein the lintel includes downwardly facing dual parallel tracks and the undershelf includes upwardly facing dual parallel tracks, and wherein the front doors are slideably mounted in the tracks for side-to-side movement.

* * * * *